US005278455A

United States Patent [19]

Hamos

[11] Patent Number: 5,278,455

[45] Date of Patent: Jan. 11, 1994

[54] SPA AND POOL PUMP AND HEATER CONTROL

[75] Inventor: Robert E. Hamos, Simi Valley, Calif.

[73] Assignee: Teledyne Industries, Inc., Los Angeles, Calif.

[21] Appl. No.: 806,319

[22] Filed: Dec. 13, 1991

Related U.S. Application Data

[63] Continuation-in-part of Ser. No. 599,711, Oct. 18, 1990, Pat. No. 5,117,233.

[51] Int. Cl.[5] ..... E04H 4/12; E03C 1/02

[52] U.S. Cl. ..... 307/139; 4/493; 4/509; 137/563; 137/624.12; 361/169.1

[58] Field of Search ..... 361/160, 166, 167, 169.1, 361/189, 190, 191, 195; 307/113, 115, 141, 141.8, 149, 154, 139; 4/492, 493, 494, 502-; 237/63; 137/341, 563, 565, 567, 624.11, 624.12; 210/102

[56] References Cited

U.S. PATENT DOCUMENTS

| | | | |
|---|---|---|---|
| 3,781,925 | 1/1974 | Curtis et al. | 4/493 |
| 4,185,333 | 1/1980 | Ortega | 4/508 |
| 4,315,248 | 2/1982 | Ward | 340/825.75 |
| 4,322,297 | 3/1982 | Bajka | 210/102 |
| 4,404,697 | 9/1983 | Hatcher | 4/492 |
| 4,424,438 | 1/1984 | Antelman et al. | 4/504 |
| 4,712,104 | 12/1987 | Kobayashi | 340/825.69 |
| 4,742,456 | 5/1988 | Kamena | 4/542 |
| 4,780,917 | 11/1988 | Hancock | 4/542 |

OTHER PUBLICATIONS

CP-2000 Pool/Spa Control System, by Compool Corporation (1989).
Comtrol Complete Pool and Spa Control, by Compool Corporation (1989).
LX-80 Commercial Pool/Spa Control System, by Compool Corporation (1989).
Swim Master Pool/Spa Control System, by Compool Corporation (1989).
Time Master, by Compool Corporation (1982).
RC1000 Series Radio Remote Control System, by Intermatic Incorporated (1988).
Radio Controls for Spas & Pools, by Intermatic Incorporated (1988).
Autospa, by Chardonnay Corporation (1986).
Pulsar Control Corporation (1989).

*Primary Examiner*—Howard L. Williams
*Assistant Examiner*—Richard T. Elms
*Attorney, Agent, or Firm*—Benoit Law Corporation

[57] ABSTRACT

A control for a spa and swimming pool pump and heater assembly with diverter valves, includes a selectively actuable pump and spa heater actuator or relay having a first latching circuit, and having a separate first unlatching switch or relay contact, a selectively actuable pump and pool heater actuator or relay having a second latching circuit including the first unlatching switch or relay contact, and having a second unlatching switch or relay contact in the first latching circuit. The control also includes a diverter valve actuator in parallel to one of the pump and spa heater actuator or relay and pump and pool heater actuator or relay.

18 Claims, 4 Drawing Sheets

SPA AND POOL PUMP AND HEATER CONTROL

CROSS-REFERENCE

This is a continuation-in-part of patent application Ser. No. 07/599,711, filed Oct. 18, 1990 by Robert E. Hamos and William F. Raleigh, issued May 26, 1992 as U.S. Pat. No. 5,117,233 to Teledyne Industries, Inc., and herewith incorporated by reference herein.

BACKGROUND

The subject invention relates to combined spa and swimming pool systems, and more specifically to controls for spa and swimming pool equipment, including pump and heater assemblies with diverter valves.

SUMMARY OF THE INVENTION

It is a principal object of the invention to provide improved controls for combined spa and swimming pool systems.

It is also an object of the invention to provide an improved versatile control board useable in spa and swimming pool systems and in other applications.

Other objects will become apparent in the further course of this disclosure.

The invention resides in a control for a spa and swimming pool pump and heater assembly with diverter valves, comprising, in combination, a selectively actuable pump and spa heater actuator or relay having a first latching circuit, and having a separate first unlatching switch or relay contact, a selectively actuable pump and pool heater actuator or relay having a second latching circuit including the first unlatching switch or relay contact, and having a second unlatching switch or relay contact in the first latching circuit, and a diverter valve actuator in parallel to one of the pump and spa heater actuator or relay and pump and pool heater actuator or relay. The control includes an OR-element, and a light on/off actuator or an auxiliary actuator or relay in parallel through that OR-element with the pump and spa heater actuator or relay and the pump and pool heater actuator or relay.

From a related aspect thereof, the invention resides in a control for a spa and swimming pool pump and heater assembly with diverter valves, comprising, in combination, means for selectively actuating the pump and heater assembly including means having a first latching circuit for actuating the pump and heater assembly in a spa mode, and having a separate first unlatching switch, and including means having a second latching circuit for actuating the pump and heater assembly in a pool mode; that second latching circuit including the first unlatching switch for interrupting that second latching circuit upon actuation of the means for actuating the pump and heater assembly in a spa mode, and the means for actuating the pump and heater assembly in a pool mode include a second unlatching switch in the first latching circuit for interrupting the first latching circuit upon actuation of the means for actuating the pump and heater assembly in a pool mode, and means in parallel to one of the means for actuating the pump and heater assembly in a spa mode and the means for actuating the pump and heater assembly in a pool mode, for actuating the diverter valves.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
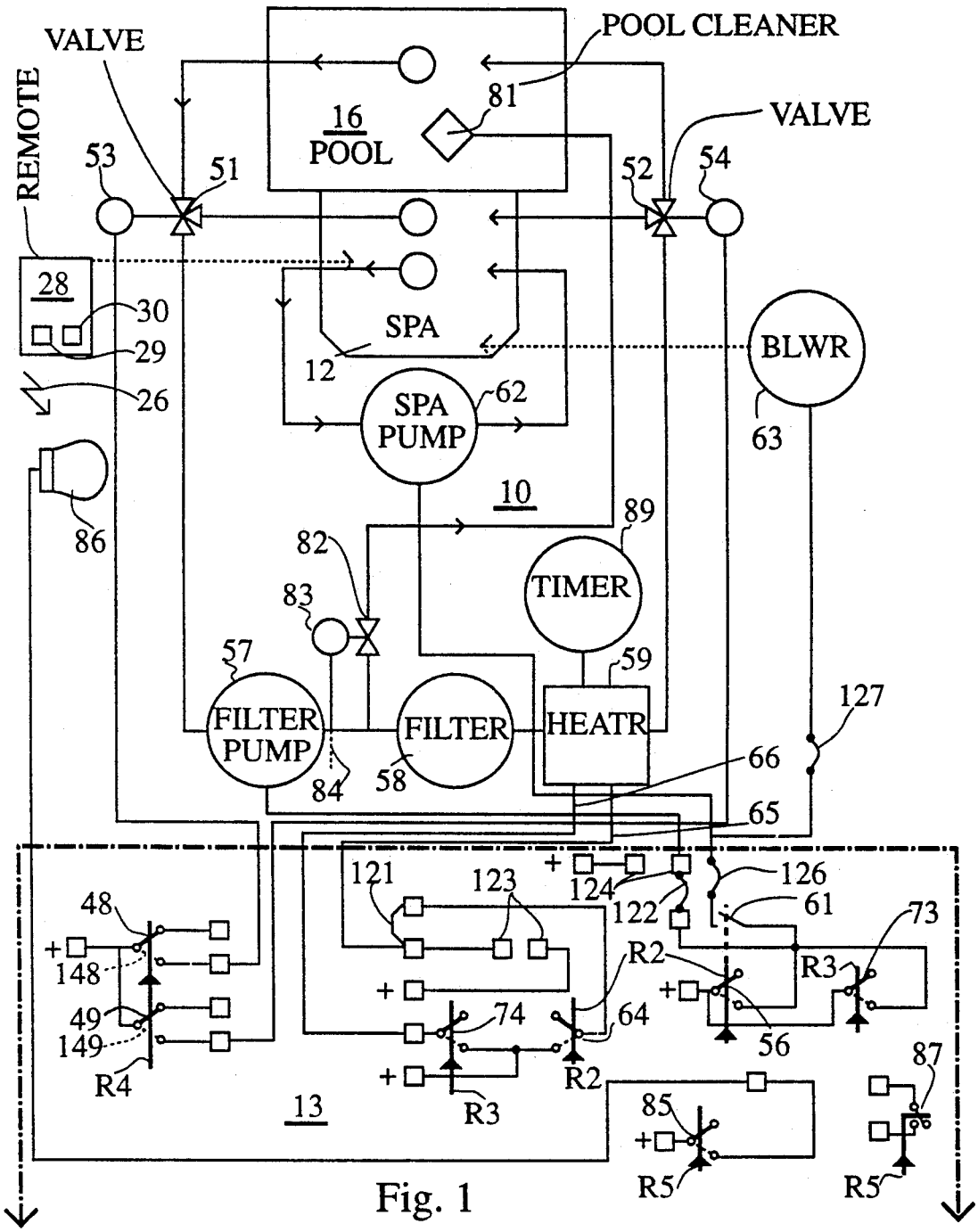
FIG. 1 is a block diagram of a spa and pool system with pump and heater assembly, diverter valves and accessories, and a circuit diagram of the switch assembly portion of a control according to an embodiment of the invention.

The invention may be seen with the aid of the drawings as apparatus for controlling equipment 10 for operating a spa 12 and a swimming pool 16, including spa and swimming pool diverter valves 51 and 52 with pump and heater assembly 57–59. Such apparatus includes a control 14 comprising a selectively actuable pump and spa heater actuator 18 having a first latching circuit 69, and having a separate first unlatching switch 78, a selectively actuable pump and pool heater actuator 19 having a second latching circuit 77 including the first unlatching switch 78, and having a second unlatching switch 71 in the first latching circuit 69, and a diverter valve actuator 20 in parallel to one of the pump and spa heater actuator 18 and pump and pool heater actuator 19.

An embodiment of the invention includes a selectively actuable control on/off actuator 17 having a third unlatching switch 91 in series with the first and second latching circuits 69 and 77. In combination or apart from that embodiment, the control 14 may include an OR-element 79 and a light on/off actuator 21 in parallel through that OR-element with the pump and spa heater actuator 18 and the pump and pool heater actuator 19.

According to a preferred embodiment of the invention, one or more relays may be used for implementing one or more of the actuators. In that case, the description hereafter will refer to each such relay by the reference numeral for the corresponding actuator.

Accordingly, the selectively actuable pump and spa heater actuator may comprise a pump and spa heater actuator relay 18 having a first latching circuit 69, and having a separate first unlatching relay contact 78 in the second latching circuit 77.

Additionally or alternatively, the selectively actuable pump and pool heater actuator may comprise a pump and pool heater actuator relay 19 having a latching circuit 77 including the first unlatching switch or relay contact 78, and having a second unlatching relay contact 71 in the first latching circuit 69.

Also additionally or alternatively, the diverter valve actuator may comprise a diverter valve actuator relay 20 in parallel to one of the pump and spa heater actuator or actuator relay 18 and pump and pool heater actuator or actuator relay 19.

All three of these relays 18, 19 and 20 may be on the same board 16.

Additionally or alternatively, the selectively actuable control on/off actuator may comprise a relay 17 having a third unlatching relay contact 91 in series with the first and second relay latching circuits 69 and 77. The phrase "third unlatching relay contact in series" is intended to be sufficiently broad to cover an individual contact of the relay 17 in each latching circuit 69 and 77. Also, the relay 17 may be an "on relay," rather than an "off relay" having a normally open contact in each latching circuit 69 and 77.

A light on/off actuator relay 21 may be in parallel through the OR-element 79 with the pump and spa heater actuator relay 18 and the pump and pool heater actuator relay 19.

All these relays and their contacts preferably are on the same board 16 for a compact control device or apparatus 13, 14.

Figure 2:
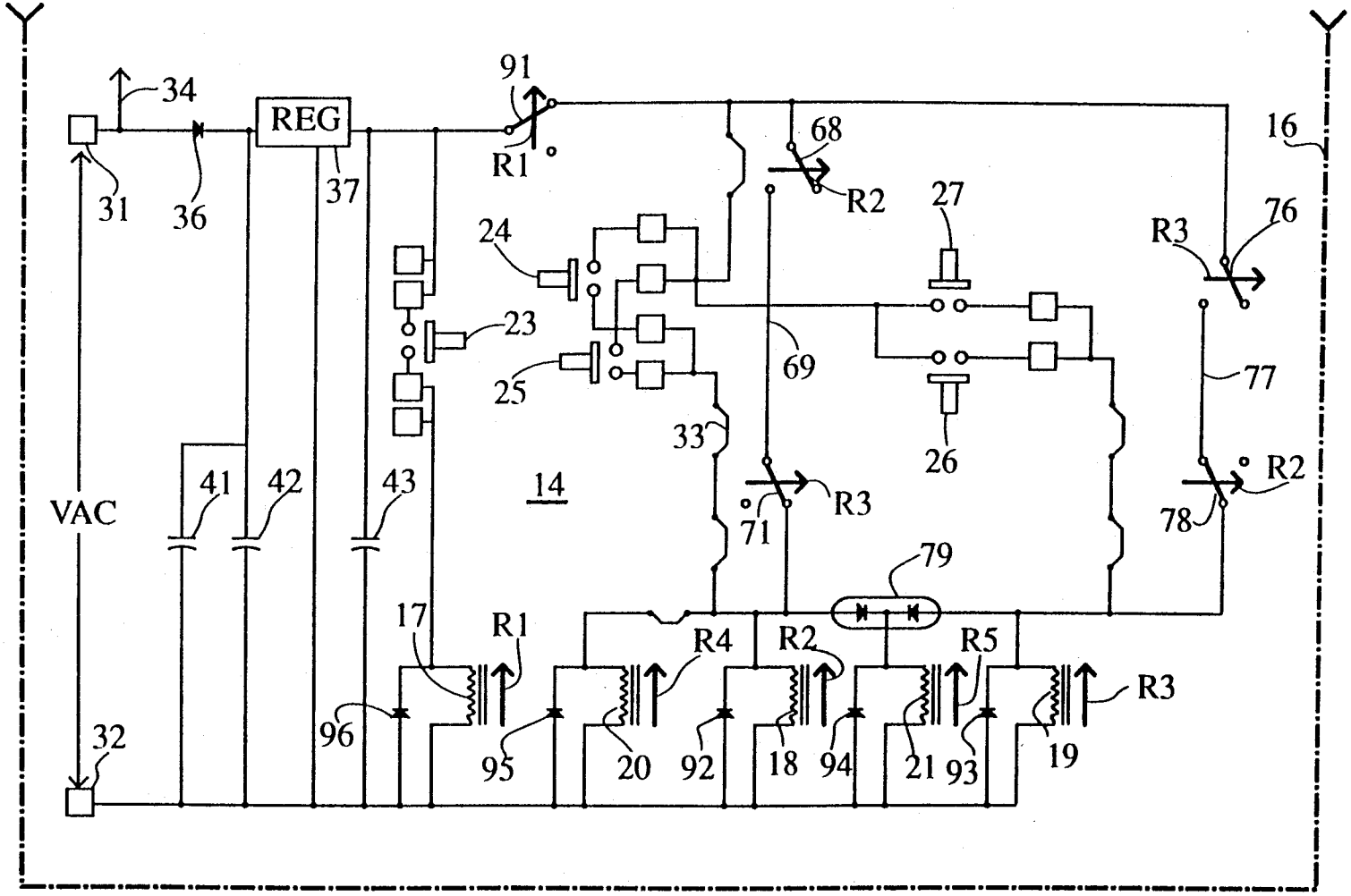
FIG. 2 is a circuit diagram of the actuator portion of the control, and may be combined with the bottom of FIG. 1 to show a complete control according to a preferred embodiment of the invention.

FIGS. 1 and 2 more particularly illustrate methods and apparatus for controlling equipment 10 for operating a spa 12 and a swimming pool 16. These illustrated methods and apparatus provide or include an electrical switch arrangement 13 for controlling the equipment 10, and an electrical control 14 for selectively actuating the switching arrangement.

The electrical switch arrangement 13 is shown on a first circuit board 16 in FIG. 1, and the control 14 is shown in FIG. 2. However, the control 14 with its relays is typically located on the circuit board 16 as well, inasmuch as the switches shown within the board 16 are contacts actuated by relays shown in FIG. 2. Accordingly, the phantom line designating the circuit board 16 in FIG. 1 is extended to include FIG. 2.

The control 14 has five relays 17, 18, 19, 20, and 21 that may, for instance, be designated as off relay, spa relay, pool relay, valve relay, and extra pool/spa relay, respectively. Each relay has associated therewith an arrow R1, R2, R3, R4, or R5, respectively, as shown in FIG. 2. Conversely, each relay contact shown on the circuit board 16 in FIG. 1 has an inverted arrow, as has each relay contact shown in FIG. 2, indicating actuation of that contact by one of the relays 17, 18, 19, 20, and 21 according to identical arrow and inverted arrow labelings R1, R2, R3, R4, and R5, respectively, in FIGS. 1 and 2.

FIG. 2 also shows typically manually actuable switches 23, 24, 25, 26 and 27 which may be part of different sets of push buttons or other switches typically separate or remote from the circuit board 16.

The circuit board has power input terminals shown by squares 31 and 32. Other terminals are also shown by small squares in FIGS. 1 and 2; some of them are provided redundantly for greater versatility of the circuit board 16.

FIG. 2 also shows several jumpers, of which jumper 33 is typical, and all of which are shown in the manner of that jumper 33. Some of these may be made removable for versatility. Most, however, are permanent as frequently provided in circuit boards to permit line crossings.

As indicated by the arrow 34 at the top of FIG. 2, the equipment 10 shown in FIG. 1 may be energized with alternating current as supplied to terminals 31 and 32, such as from line voltage, typically after step-down transformation for safety. Accordingly, if terminals receiving power in FIG. 1 are designated by a plus sign (+), that does not necessarily mean that rectified or direct current is applied. Rather, alternating current may be applied to these "plus terminals" (+), such as in a manner indicated by the output arrow 34 in FIG. 2.

In the embodiment shown in FIG. 2, the input alternating-current power is rectified at 36, regulated by a voltage regulator 37 that may be of a conventional type, and smoothened by filter capacitors 41, 42 and 43. The resulting direct-current power energizes the control 14.

Switches 24 and 25 shown in FIG. 2 are for spa control, and switches 26 and 27 are for pool control. By way of example, switches 24 and 26 may be push buttons located at the heater 59 (heater board) or at a control box or center. Switches 25 and 27, conversely, may be push buttons located remotely from the locality of push buttons 24 and 26. For instance, the switch or push button 25 may be located at the spa 12, and the switch or push button at the pool 16. Alternatively, either or both of these switches 25 and 27 may be situated at the control 14, but actuated by remote control from the spa and/or pool. By way of example, FIG. 1 shows a remote control 28 with push buttons 29 and 30 for actuating the switches 25 and 27, respectively. A wired or wireless remote control may be used in practice, and reference may be had to the above-identified parent patent and to references cited therein and herewith incorporated by reference herein.

If either of the switches 24 and 25 is actuated or depressed, the spa relay 18 and valve relay 20 are energized and actuate the relay contacts at which an inverted arrow R2 or R4 is located.

In the embodiment of FIG. 1, this switches the filter pump and heater train, including a filter pump 57, filter 58 and heater 59, from the pool 16 to the spa 12, at least as far as the supply and circulation of heated water is concerned. To this effect, the energized relay 20 switches its relay contacts 48 and 49 to effect a switching of diverter valves 51 and 52 from pool mode to spa mode through energization of valve solenoids or other electrical actuators 53 and 54.

The energized relay 18 then switches its contact 56 to energize the filter pump 57 for the pumping of water from the spa 12 through actuated diverter valve 51, pump 57, filter 58, heater 59, actuated diverter valve 52 and back to the spa 12.

When claims and part of the disclosure hereof call for a diverter valve actuator in parallel to one of the pump and spa heater actuator and pump and pool heater actuator, or use language of similar import, they do not exclude expansion of that actuator to a stepping relay connected to both spa and pool relays or actuators 18 and 19, such as through an OR-element similar to the OR-element 79 shown in FIG. 2, or the addition of a further diverter valve actuator in parallel to the other of said pump and spa heater actuator and pump and pool heater actuator.

While not limited to any specifically disclosed components or circuitry, the core of the control 13, 14 may be seen as a means for selectively actuating the pump and heater assembly 57–59, including means 18 having a first latching circuit 69 for actuating that pump and heater assembly in a spa mode, and having a separate first unlatching switch 78, and including means 19 having a second latching circuit 77 for actuating that pump and heater assembly in a pool mode; that second latching circuit 77 including the first unlatching switch 78 for interrupting that second latching circuit upon actuation of the means 18 for actuating the pump and heater assembly in a spa mode, and the means 19 for actuating that pump and heater assembly in a pool mode include a second unlatching switch 71 in the first latching circuit 69 for interrupting that first latching circuit upon actuation of the means 19 for actuating the pump and heater assembly in a pool mode. Relay 20 or equivalents thereof may be seen as means in parallel to one of the means 18 for actuating the pump and heater assembly in a spa mode and the means 19 for actuating that pump and heater assembly in a pool mode, for actuating the diverter valves 51 and 52, such as via actuators 53 and 54.

FIG. 1 also shows a further switch 61 for actuating a spa pump 62 for providing liquid jets in the spa 12 that may be laced with air bubbles from a blower 63. FIG. 1 shows that additional switch 61 ganged with the relay contact 56 and thereby actuated by the relay 18. However, the spa pump switch 61 may be actuated manually or from a control separate from control 14.

Also, instead of a spa pump 62, the filter pump 57 may be provided with an additional winding or other step-up feature which will cause the filter pump to operate as a spa pump when energized through an additional terminal to which the switch 61, which may be separate from the relay 18, may be connected.

Relay 18 also switches its contact 64 whereby the heater 59 is actuated through control line 65. It may be noted that the heater 59 has two control lines, a line 65 for increased heating, which will provide hot spa water, and a line 66 for normal heating, which will provide warm water for pool and spa. Energization of relay 18 and closure of relay contact 64 energize the heater 59 to provide hot water for the spa 12.

Relay 18 also closes a latch contact 68 that will hold relays 18 and 20 energized and their diverter valve and spa functions continued after depression of either of the spa switches or push buttons 24 and 25. On the other hand, actuation or depression of either of the pool switches 26 and 27 will open or break that latching circuit, whereby relays 18 and 20 are deenergized.

In particular, actuation or depression of either of the switches or push buttons 26 and 27 causes energization of the pool relay 19 and thereby actuation of all relay contacts designated by a reverse arrow R3. Accordingly, relay 19 opens its normally closed contact 71 to break the latching circuit 69 for deenergization of relays 18 and 20. That also returns the contacts 48 and 49 of relay 20 to their position shown in FIG. 1, whereby the diverter valves 51 and 52 return to their pool-mode positions.

Figure 3:
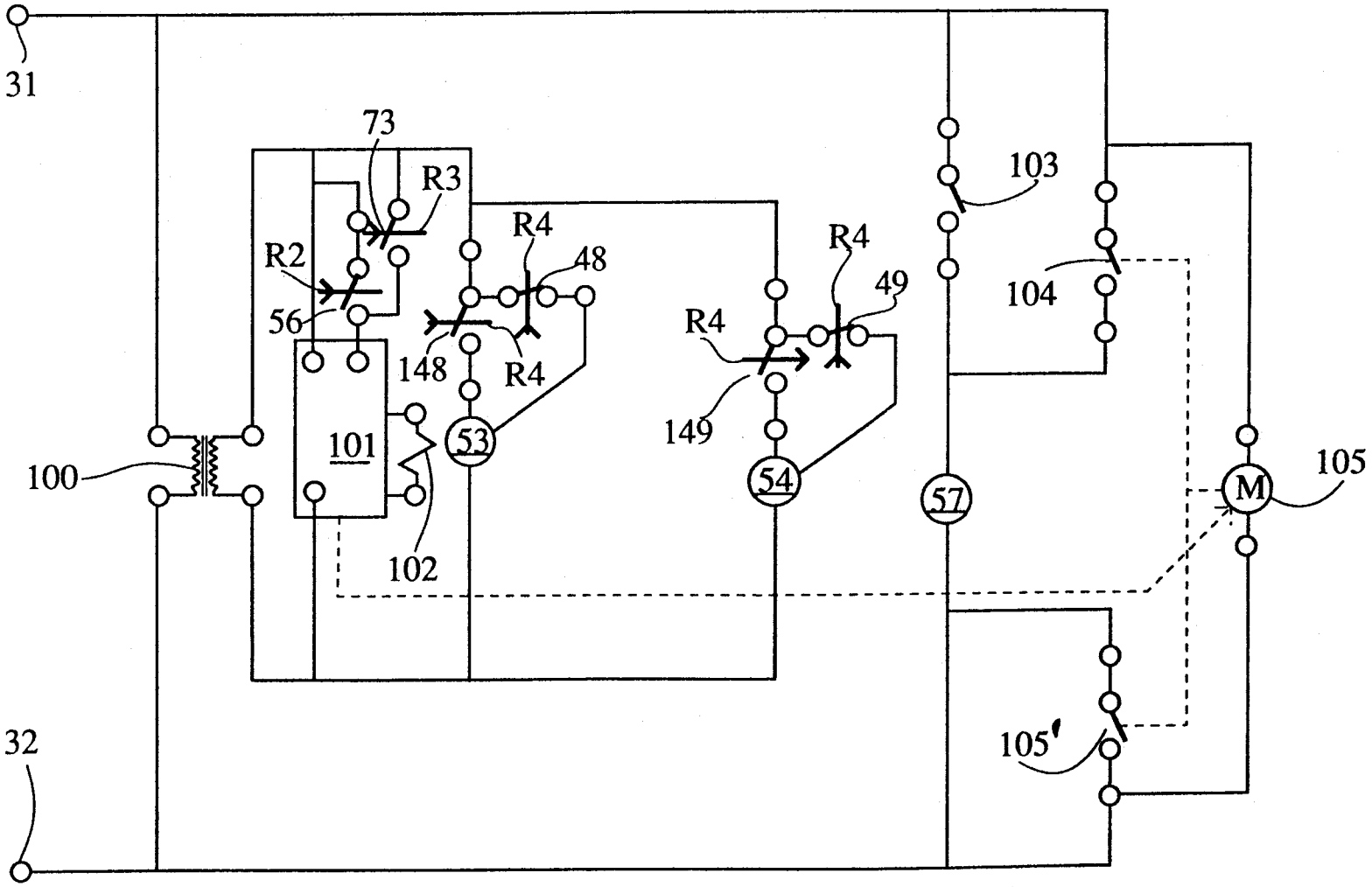
FIG. 3 is a circuit diagram of a modified control according to an embodiment of the invention.

This return may be automatic upon deenergization of the valve relay 20, if the diverter valves 51 and 52 are spring-biased to their pool-mode. In this respect, FIG. 3 shows an alternative pursuant to which the diverter valves 51 and 52 are electrically actuated to their pool-mode position, as more fully described below.

In either case, water is pumped from the pool 16 through diverter valve 51, pump 57, filter 58, heater 59, and diverter valve 52 back to that pool 16, upon actuation of the filter pump contact 73 in FIG. 1 by the relay 19.

That energized relay 19 also closes its contact 74 to energize the heater 59 through its control line 66, whereby warm water is supplied to the pool 16.

The energized relay 19 further closes its latch contact 76, whereby that relay will remain energized and its pool-mode functions continued, until its latching circuit 77 is interrupted, such as by an opening of a contact 78 through reenergization of relay 18, such as by depression of push button 24 or 25, whereby the diverter valves 51 and 52 and the remainder of equipment 10 will be reactivated to their spa-mode, as described above.

The illustrated embodiment of the control 14 also has the extra pool/spa relay 21 energized through an OR element 79 upon actuation or depression of any of the switches or push buttons 24 to 27. That extra relay 21 may perform various functions, which typically may be of an auxiliary nature.

Figure 4:
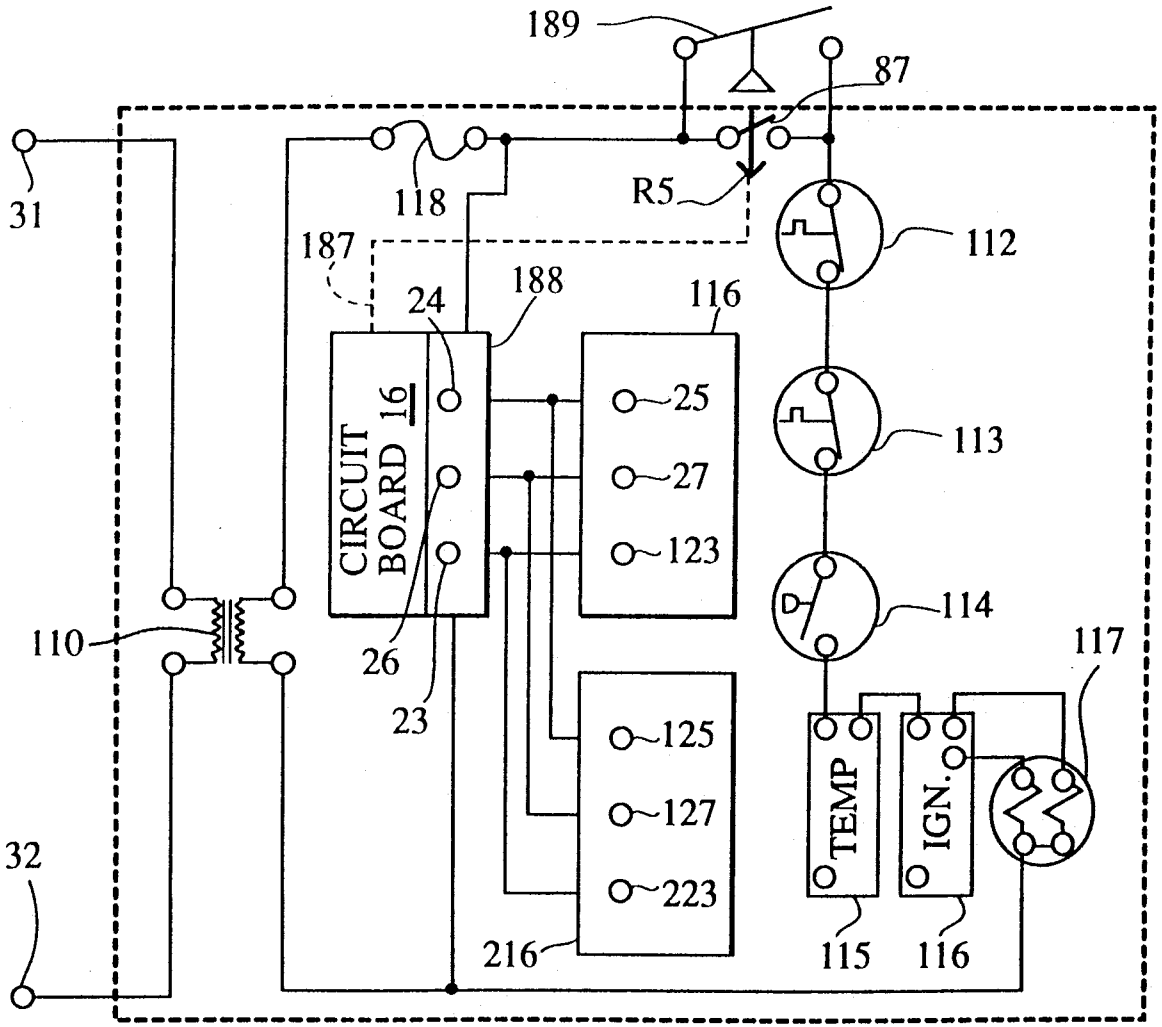
FIG. 4 is a circuit diagram of a spa and pool temperature control with safety features and with a timer override according to an embodiment of the invention.

By way of example, the relay 21 may close a contact 85 for energization of a pool or spa lamp or flood lighting 86. The relay 21 may also close an auxiliary contact 87, such as for an illumination of switches and controls at the push buttons 24 and 26 and/or push buttons 25 and 27 and/or for a bypass of a switch 189 as shown in FIG. 4, for a timer 89 shown in FIG. 1.

The off relay 17 is energized by closure or depression of the switch or push button 23. As indicated by inverted arrow R1, this opens a latching contact 91 which opens or breaks the latching circuits 69 and 77 of spa, pool, valve and auxiliary relays 18, 19, 20 and 21. Noise eliminator diodes 92, 93, 94 and 95 eliminate voltage spikes and noise when the relays 18 to 20 are deenergized, and a diode 96 performs the same function for the off relay 17 when the push button 23 is released.

FIG. 3 shows an embodiment that may be implemented into the system of FIGS. 1 and 2 or used otherwise, such as with the control of FIG. 2.

FIG. 3 is based on the assumption that the spa/pool water diverter valves 51 and 52 are not spring-biased to a certain position, but have to be actuated to the spa-mode and to the pool-mode as well. Accordingly, each of the valve solenoids or electrical actuators 53 and 54 is of a two-way type, as more fully described below.

FIG. 3 also shows actuators and energizers of the filter pump 57 in greater detail.

In particular, FIG. 3 again shows power input terminals 31 and 32 for receiving alternating-current power. Part of that power is applied to a transformer 100 and is then applied to the diverter valve actuators 53 and 54 through normally closed contacts 48 and 49 in the position solidly shown in FIG. 1. In that case, the diverter valves are in the pool-mode.

When the valve relay 20 is energized, such as in the manner described above, the contacts 48 and 49 are opened and corresponding contacts 148 and 149 of that relay 20 are closed, so that the two-way electrical actuators 53 and 54 drive the diverter valves 51 and 52 to the spa-mode as described in FIG. 1. Relay contacts 148 and 149 in this respect correspond to the dotted position of contacts 48 and 49 shown in FIG. 1.

While the control 14 thus sets the flow diverter valves 51 and 52 to their desired position, closure of either the contact 56 of the spa relay 18, or contact 73 of the pool relay 19, energizes from the transformer 100 a contactor 101 of a type commonly used in swimming pool operations. That contactor, in turn, energizes a winding 102 which is either a winding for the filter pump 57 or, in FIG. 3, a relay winding for closing a contact 103 when energized.

In either case, the filter pump 57 is started instantly to make sure that the water is circulating when the heater is started, such as by closure of the relay contact 64 for spa operation, or 74 for pool operation, as in FIG. 1.

Conversely, to avoid overheating, the filter pump 57 is not immediately stopped when the stop switch 23 is depressed, or when the relay contact 56 or 73 is otherwise opened. Rather, the contactor is provided with a time delay in its opening phase. That time delay on deenergization may either be internal of the contactor 101 or may be external.

An external time delay is illustrated in FIG. 3 where a timer 105 closes contacts 104 and 105 for energizing the filter pump 57 in parallel to the contactor-actuated switch 103. In practice, that timer 105 starts its timing action when the contactor 101 deenergizes upon opening of either contact 56 or 73.

The timer 105 thus keeps the filter pump 57 pumping for a sufficient time after the heater 59 has been deenergized to avoid thermal damage. In this respect, when an opening of contact 64 or 74 deenergizes the heater 59, its heat exchanger still is hot and needs cooling by water circulated by the pump 57 for a while.

Further safety and operational features are disclosed in FIG. 4, showing apparatus that may be combined with the apparatus of FIG. 3 for energization through the same power input terminals 31 and 32.

In particular, FIG. 4 shows a first limit switch 112, a second limit switch 113, a pressure switch 114, and an adjustable temperature control 115 in series with a fuse 118 and a switch 189 of a timer 89 shown in FIG. 1. Operation can start when that timer closes its switch 189, and thereby connects the circuit just described to the secondary winding of a transformer 110.

Switches 112, 113 and 114 are safety switches. In particular, switch 112 monitors the temperature of the water pumped into the pool or spa and remains closed as long as the temperature of that water does not exceed a level considered safe for human use. The switch 113 in series therewith monitors for objectionable steam formation and remains closed as long as the water temperature in the spa or pool supply pipe does not exceed the boiling point.

Switch 114 in series therewith is a pressure switch monitoring water pressure produced by the filter pump 57 and remains closed as long as the filter pump is operating safely.

Accordingly, the temperature control 115, connected in series therewith, can only operate during safe spa and pool operation. While the safety system of FIG. 4 is essentially timer controlled, an embodiment of the invention bypasses the timer 89 with the contact 87 of the extra relay 21 when the control 14 is set for spa or pool operation. This provides a manual override of the timer through any of the switches 24 to 27, at least some of which, such as switches 24 and 26, may be located at the temperature control 115 or on a panel provided therefor.

More generally, an embodiment of the invention has a timer 89 for the pool heater 59, and includes an OR-element 79, as in FIG. 2, and a timer bypass actuator or relay 21 in parallel through that OR-element with the pump and spa heater actuator or relay 18 and the pump and pool heater actuator 19, such as in FIG. 2. FIG. 4 shows an example of an implementation of such embodiment, such as described above with respect to the contact 189 of the timer 89 and the contact 87 of the relay 21 in parallel or bypass to such timer contact. The actuator or relay 21 may have other functions, such as switching the lamp 86 or other lights as mentioned above.

A dotted line 187 in FIG. 4 indicates that the relay contact 87 belongs to the circuit board 16. In this respect, FIG. 4 diagrammatically shows the circuit board 16 shown more specifically in FIGS. 1 and 2, with push buttons 23, 24 and 26 shown only in top view on FIG. 4 on a switching board 188. The remote switches or push buttons 25 and 27 are also shown in top view on a remote switching board 116, including also a remote stop or off switch or push button 123 connected in parallel to the local stop or off switch. In this manner, the spa, pool and stop modes may be controlled from a location, such as the pool and spa side, remote from the heater or control center area.

Further remote control facilities may easily be added to the system of the subject invention. In this respect, FIG. 4 shows a second remote control board with a further set of spa, pool and stop mode switches or push buttons 125, 127 and 223 connected in parallel to the local switches or push buttons 23, 24 and 26, respectively.

In practice, the switching board 116 may be located at the spa 12 and the switching board 216 at the pool 16, for instance. Other examples include locating the switching board 216 in an adjacent building at a window overlooking the pool-spa area. In this respect, more remote switching boards are easily added in the manner shown for the board 216.

While many of the claims and some of the disclosure mention a pool heater and a spa heater, these two entities may be separate or combined, such as shown at 59 in FIG. 1, with separate spa and pool heater controls 65 and 66, if desired.

The temperature control 115 may be a manually settable thermostat which senses pool or spa temperature. When that temperature is or falls below a set temperature, the control 115 energizes an ignition control 116 and opens a gas valve 117 in the heater 59, whereby the circulating water is heated to a desired temperature, until it reaches the value set at 115 or until one or more of the safety switches 112, 113 and 114 open.

In practice, there may be separate temperature settings or separate thermostats for spa and pool in the control 115, to provide hotter water for the spa 12 than for the pool 16. A relay contact arrangement similar to that of contacts 64 and 74 shown in FIG. 1 can be provided and used to select the appropriate temperature setting or thermostat.

Different remote control embodiments have been mentioned above. Another possibility is to use the wireless remote control including transmitter 19 and receiver 28 with channels 47 and 48 all as shown and disclosed in the above-identified and incorporated patent application or patent.

In this respect, the first channel (CH 1) of that remote control can, for instance, actuate the switch 25 in the control 14 shown in FIG. 2.

Alternatively, that first channel may have conventional on-off outputs connected in lieu of the jumpers 121 and 122 in FIG. 1, with such jumpers being then inserted between terminals 123 and 124, respectively. In that case, the remotely controlled first channel (CH 1) shown in the above-identified parent patent directly controls the filter pump 57 and the increased heater energization at least in the spa mode.

The second channel (CH 2) shown in the above-identified parent patent can then also be used in the embodiment shown in FIG. 1 of this patent. For instance, jumpers 126 and 127 shown in this FIG. 1 may for instance be connected to the brushes of contactor discs 93 and 94 shown in the above-identified parent patent for a control of the spa pump 62 and blower 63 shown in this patent in the manner of spa pump 39 and blower 45 of the above-identified parent patent disclosing the manual control MAN 2 and the second wireless channel CH 2 and a stepping relay 90 or multiplexer 41.

The automatic pool cleaner 81 may be handled in the same manner as disclosed by reference to components 82 to 84 in the above-identified parent patent using these same reference numerals.

The subject extensive disclosure will render apparent or suggest to those skilled in the art various modifications and variations within the spirit and scope of the subject invention and equivalents thereof.

I claim:

1. A control for a spa and swimming pool pump and heater assembly with diverter valves, comprising in combination:

a selectively actuable pump and spa heater actuator having a first latching circuit, and having a separate first unlatching switch;

a selectively actuable pump and pool heater actuator having a second latching circuit including said first unlatching switch, and having a second unlatching switch in said first latching circuit;

a diverter valve actuator in parallel to one of said pump and spa heater actuator and pump and pool heater actuator;

an OR-element; and a light on/off actuator in parallel through said OR-element with said pump and spa heater actuator and said pump and pool heater actuator.

2. A control as in claim 1, including:

a selectively actuable control on/off actuator having a third unlatching switch in series with said first and second latching circuits.

3. A control as in claim 1, wherein:

said light on/off actuator includes a light on/off actuator relay in parallel through said OR-element with said pump and spa heater actuator and said pump and pool heater actuator.

4. A control as in claim 1, wherein:

said selectively actuable pump and spa heater actuator comprises a pump and spa heater actuator relay having said first latching circuit, and having a separate first unlatching relay contact as said first unlatching switch in said second latching circuit.

5. A control as in claim 1, wherein:

said selectively actuable pump and pool heater actuator comprises a pump and pool heater actuator relay having a latching circuit including said first unlatching switch, and having a second unlatching relay contact in said first latching circuit.

6. A control as in claim 1, wherein:

said diverter valve actuator comprises a diverter valve actuator relay in parallel to one of said pump and spa heater actuator and pump and pool heater actuator.

7. A control as in claim 1, including:

a timer for said pool heater;

an OR-element; and a timer bypass actuator in parallel through said OR-element with said pump and spa heater actuator and said pump and pool heater actuator.

8. A control as in claim 1, wherein:

said selectively actuable pump and spa heater actuator comprises a pump and spa heater actuator relay having said first latching circuit, and having a separate first unlatching relay contact as said first unlatching switch in said second latching circuit;

said selectively actuable pump and pool heater actuator comprises a pump and pool heater actuator relay having said second latching circuit including said first unlatching relay contact, and having a second unlatching relay contact as said second unlatching switch in said first latching circuit; and said diverter valve actuator comprises a diverter valve actuator relay in parallel to one of said pump and spa heater actuator relay and pump and pool heater actuator relay.

9. A control as in claim 8, including:

a selectively actuable control on/off actuator relay having said third unlatching relay contact in series with said first and second latching circuits.

10. A control as in claim 8, wherein:

said light on/off actuator includes a light on/off actuator relay in parallel through said OR-element with said pump and spa heater actuator relay and said pump and pool heater actuator relay.

11. A control for a spa and swimming pool pump and heater assembly with diverter valves, comprising in combination:

means for selectively actuating said pump and heater assembly including means having a first latching circuit for actuating said pump and heater assembly in a spa mode, and having a separate first unlatching switch, and including means having a second latching circuit for actuating said pump and heater assembly in a pool mode, said second latching circuit including said first unlatching switch for interrupting said second latching circuit upon actuation of said means for actuating said pump and heater assembly in a spa mode, and said means for actuating said pump and heater assembly in a pool mode include a second unlatching switch in said first latching circuit for interrupting said first latching circuit upon actuation of said means for actuating said pump and heater assembly in a pool mode;

means in parallel to one of said means for actuating said pump and heater assembly in a spa mode and said means for actuating said pump and heater assembly in a pool mode, for actuating said diverter valves;

an OR-element; and an auxiliary actuator in parallel through said OR-element with said means for actuating said pump and heater assembly in a spa mode and said means for actuating said pump and heater assembly in a pool mode.

12. A control as in claim 11, including:

means for selectively switching said control, including a third unlatching switch in series with said first and second latching circuits.

13. A control as in claim 11, wherein:

said auxiliary actuator includes an auxiliary actuator relay in parallel through said OR-element with said means for actuating said pump and heater assembly in a spa mode and said means for actuating said pump and heater assembly in a pool mode.

14. A control as in claim 11, wherein:

said means for actuating said pump and heater assembly in a spa mode comprise a relay having said first latching circuit, and having a separate first unlatching relay contact as said first unlatching switch in said second latching circuit.

15. A control as in claim 11, wherein:

said means for actuating said pump and pool heater assembly in a pool mode comprise a relay having a latching circuit including said first unlatching switch, and having a second unlatching relay contact in said first latching circuit.

16. A control as in claim 11, wherein:

said means for actuating said diverter valves include a relay in parallel to one of said means for actuating said pump and heater assembly in a spa mode and said means for actuating said pump and heater assembly in a pool mode.

17. A control as in claim 11, including:

a timer for said pool heater;

an OR-element; and means in parallel through said OR-element with said means for actuating said pump and heater assembly in a spa mode and said means for actuating said pump and heater assembly in a pool mode, for selectively bypassing said timer.

18. A control as in claim 11, wherein:

said means for actuating said pump and heater assembly in a spa mode comprise a first relay having said first latching circuit, and having a separate first unlatching relay contact as said first unlatching switch in said second latching circuit;

said means for actuating said pump and pool heater assembly in a pool mode comprise a second relay having said second latching circuit including said first unlatching relay contact, and having a second unlatching relay contact in said first latching circuit; and said means for actuating said diverter valves include a third relay in parallel to one of said first and second relays.

* * * * *